United States Patent [19]

Tsuchitani et al.

[11] Patent Number: 4,820,401

[45] Date of Patent: Apr. 11, 1989

[54] PROCESS FOR THE PREPARATION OF MESOPHASE PITCHES

[75] Inventors: Masatoshi Tsuchitani, Ichihara; Sakae Naito, Chiba; Ryoichi Nakajima, Ichihara, all of Japan

[73] Assignees: Kozo Iizuka; Maruzen Petrochemical Co., Ltd., both of Tokyo, Japan

[21] Appl. No.: 48,376

[22] Filed: May 11, 1987

[30] Foreign Application Priority Data

May 19, 1986 [JP] Japan ..... 61-114221

[51] Int. Cl.[4] ..... C10C 3/00

[52] U.S. Cl. ..... 208/40; 208/22; 208/39; 208/44; 423/447.1; 423/447.2; 423/447.4

[58] Field of Search ..... 208/22, 39, 40, 44; 423/447.1, 447.2, 447.4

[56] References Cited

U.S. PATENT DOCUMENTS

| | | | |
|---|---|---|---|
| 3,970,542 | 7/1976 | Bongertmann | 208/22 |
| 4,292,170 | 9/1981 | Simone . | |
| 4,397,830 | 8/1983 | Uemura et al. | 208/40 |
| 4,448,670 | 5/1984 | Dickakian | 208/40 |
| 4,460,454 | 7/1984 | Iijima et al. | 208/40 |
| 4,460,455 | 7/1984 | Moriya et al. | 208/40 |
| 4,504,455 | 3/1985 | Otani et al. | 208/39 |
| 4,518,483 | 5/1985 | Dickakian | 208/39 |
| 4,521,294 | 6/1985 | Uemura | 208/40 |
| 4,528,087 | 7/1985 | Shibatani et al. . | |
| 4,529,499 | 7/1985 | Watanabe | 208/39 |
| 4,533,461 | 8/1985 | Izumi et al. | 208/40 |
| 4,575,412 | 3/1986 | Yudate et al. | 208/40 |
| 4,589,975 | 5/1986 | Yudate et al. | 208/39 |
| 4,596,652 | 6/1986 | Shibatani et al. | 208/39 |
| 4,606,808 | 8/1986 | Yamada et al. | 208/39 |
| 4,645,584 | 2/1987 | Didchenko et al. | 208/40 |
| 4,705,618 | 11/1987 | Tsuchitani et al. | 208/44 |
| 4,759,839 | 7/1988 | Ishikawa et al. | 208/40 |

FOREIGN PATENT DOCUMENTS

| | | | |
|---|---|---|---|
| 63052 | 10/1982 | European Pat. Off. | 208/22 |
| 083135 | 12/1982 | Japan | 208/22 |
| 8786 | 1/1983 | Japan | 208/44 |
| 1163991 | 7/1986 | Japan | 208/40 |

*Primary Examiner*—Asok Pal

*Attorney, Agent, or Firm*—Frishauf, Holtz, Goodman & Woodward

[57] ABSTRACT

A process for the preparation of an excellent mesophase pitch suitable for use as a spinning pitch for the production of high performance carbon fibers is disclosed. The mesophase pitch can satisfy the four remarkable characteristics at the same time, i.e., a softening point of below 320° C. as determined by Mettler method, a mesophase content of above 90% as examined on a polarized microscope, a quinoline insoluble content of less than 20%, and a xylene soluble content of less than 20%. The mesophase pitch is particularly homogeneous and is easily spinnable. The process can be characterized by a preliminary extraction step, a continuous heat treatment step, and an extraction step. In some cases, the preliminary extraction step can be omitted. Graphite fibers having a tensile strength of about 400 Kg/mm$^2$ and a modulus of elasticity of above 60 ton/mm$^2$ can be obtained from the mesophase pitch. Further, even carbon fibers prepared at a carbonization temperature of 1000° C. have a tensile strength of about 300 Kg/mm$^2$.

17 Claims, No Drawings

PROCESS FOR THE PREPARATION OF MESOPHASE PITCHES

BACKGROUND OF THE INVENTION

1. Field of the Invention

This invention relates to a process for preparing a mesophase pitch which has a low softening point and is homogeneous. More specifically, this invention is concerned with a process for preparing a mesophase pitch from a high melecular weight bituminous material obtained from a heavy oil of petroleum or coal origin, by hydrogenation thereof under heating in the presence of a hydrogen-donating solvent, and a successive heat treatment of the thus hydrogenated bituminous material, and is particularly directed to a process for preparing a mesophase pitch characterized in that the high molecular weight bituminous material is produced through the following three steps: the preliminary step of producing a refined heavy oil or heavy component which comprises adding a monocyclic aromatic hydrocarbon solvent to a heavy oil of petroleum or coal origin or a heavy component obtainable by a distillation, a heat treatment or a hydro-treatment thereof, separating and removing the insoluble components; the first step of subjecting the refined heavy oil or heavy component to a heat treatment in a tubular heater in the presence or absence of an aromatic oil; and the second step of adding a monocyclic aromatic hydrocarbon solvent to the thus heat-treated material and recovering the insoluble component newly formed in the first step. In some cases, the preliminary step can be omitted. The mesophase pitch prepared by the process of this invention is particularly suitable as a spinning pitch for producing high performance carbon fibers.

The high performance carbon fiber is light in weight, and has a high strength and a high modulus of elasticity, and therefore, the substance is highly valuable as composite materials usable for various parts of aircrafts, sports goods, industrial robots, and the like. Demands of the high performance carbon fiber are expected to largely increase in future.

2. Description of the Prior Arts

Hitherto, a major source of the high performance carbon fiber has been polyacrylonitrile (PAN) based carbon fibers which are produced by spinning PAN, rendering them infusible in an oxydizing atmosphere, and carbonizing or graphitizing them in an inert gas atmosphere. In recent years, however, processes were found to produce from pitches high performance carbon fibers which are competitive or even superior to the PAN based carbon fibers in their properties. Since pitches are an inexpensive raw material, the findings have drawn a great attention as a route for preparing high performance carbon fibers at a low cost.

In preparing the high performance carbon fibers from a pitch, the spinning pitch must be a so-called mesophase pitch which contains, as a major component, the substance exhibiting an optically anisotropic mesophase when examined on a polarized microscope.

This mesophase is a kind of liquid crystals which is formed when a heavy oil or a pitch is thermally treated, and its optically anisotropic character is due to an agglomerated layered structure of thermally polymerized planar aromatic molecules. When such mesophase is subjected to melt spinning, the planar aromatic molecules are aligned to the direction of the fiber axis due to the stress exerted to the melt as it passes through a nozzle hole, and this oriented structure can be kept without being disrupted throughout subsequent steps to render it infusible and carbonization steps, and therefore, high performance carbon fibers having good orientation can be obtained. On the contrary, when an isotropic pitch containing no mesophase is used, such orientation does not occur sufficiently by the stress when molten pitch passes through a nozzle hole because of the insufficient development of planar structure of molecules, and this renders the fibers poorly oriented and produces a carbon fiber with a lower strength, even if it is rendered infusible and carbonized. Therefore, a number of known processes for the manufacture of a high performance carbon fiber from pitches are directed to the method for preparing mesophase pitches spinnable into the fiber.

In the decade of 1965–1974, the mesophase was considered as equivalent of the substance insoluble in polar solvents such as quinoline and pyridine because of the fact that the mesophase produced by the thermal treatment was insoluble in such polar solvents. Subsequent studies on the mesophase, however, have unveiled the fact that the portion of the pitch which exhibits anisotropy under a polarized microscope is not necessarily the same substances with polar solvent insoluble substances, and further that the mesophase is composed of both polar solvent soluble and insoluble components. It is thus common nowadays to define the term "mesophase" as "a portion exhibiting optical anisotropy when examined on a polarized microscope". Furthermore, it is general to express the mesophase content by the ratio of areas exhibiting optical anisotropy and isotropy when a pitch is examined on a polarized microscope.

The mesophase content as determined according to this definition represents a property of a pitch having a great significance on its spinnability as well as the characteristics of the carbon fiber made therefrom. Japanese Patent Laid-Open No. 55625/1979 describes a pitch containing essentially 100% of mesophase, and states that it is desirable to reduce an isotropic portion as much as possible, because the presence of isotropic portion interferes with the spinning operation. The reason is that a pitch with a smaller mesophase content tends to separate into two phases in a molten state due to the lower viscosity of the isotropic portion than the anisotropic mesophase. When on tries, however, to increase the mesophase content of a pitch, the softening point and the viscosity become significantly high, making it difficult to spin the pitch. Thus, the most important problem in a process for preparing a high performance carbon fiber from a mesophase pitch resides in the fact that a significantly high temperature is necessary to use at the spinning stage because of the high softening point of the pitch. Spinning at a temperature of above 350° C. involves such problems as cutting off of fibers and decrease of the fiber strength resulting from decomposition, deterioration, or thermal polymerization of the pitch in the spinning facility. Since a temperature which is 20°–40° C. higher than the Mettler method softening point of the pitch is generally required for the spinning, the softening point of the mesophase pitch must be below 320° C. in order to keep the spinning temperature lower than 350° C. The pitches described in Japanese Patent Laid-Open No. 55625/1979 have Mettler method softening point of 330°–350° C., which is not necessarily sufficiently low for the spinning operation, and in the examples, spinning is carried out at a high temperature of above 350° C.

Japanese Patent Laid-open No. 154792/1983 discloses a quinoline soluble mesophase, and states that the content of the quinoline soluble mesophase in a pitch must be higher than a specific amount because the quinoline or pyridine insoluble mesophase raises the softening point of a mesophase pitch. There is no detailed description in this Japanese Patent Laid-open about the differences between the quinoline insoluble and soluble mesophase, but it may easily be understood that a highly polymerized substance with an extraordinarily high molecular weight would be insoluble in quinoline, and therefore, in other words, an attempt for preparing a pitch with a high quinoline soluble content would lead to an effort to reduce the content of such extraordinarily high molecular weight components and to prepare a homogeneous pitch having a narrow molecular weight distribution.

It is easy to reduce the quinoline insoluble component itself by, for example, employing a mild heat treating condition. But, this leads to a significant decrease in the mesophase content and an increase in low molecular weight components which are soluble in a solvent such as xylene. This xylene soluble low molecular weight component will have an adverse effect to the orientation of the fiber while spinning, and evaporate at the spinning temperature giving a cause of the fiber cut off. Therefore, in order to prepare a mesophase pitch with an excellent quality, it is not sufficient merely to decrease the content of exceedingly high molecular weight components which are insoluble in quinoline. Xylene soluble low molecular weight components must also be decreased, so as to make the pitch homogeneous and increase the content of intermediate components.

Various methods have been proposed other than those described above for preparing such homogeneous pitches. In one of the methods, an isotropic pitch is extracted by a solvent and the insoluble components are thermally treated at a temperature of 230°–400° C. (Japanese Patent Laid-opn No. 160427/1979). Other methods comprise hydrogenation of an isotropic pitch in the presence of a hydrogen-donating solvent, followed by a heat treatment (Japanese Patent Laid-open Nos. 214531/1983 and 196292/1983). Still other method employs a repetition of a thermal treatment on a pitch which was obtained by removing mesophase from a thermally treated isotropic pitch (Japanese Patent Laid-open No. 136835/1983). Further, still other method can give a pitch containing 20–80% of mesophase by a thermal treatment, and then recover the mesophase by precipitation (Japanese Patent laid-open No. 119984/1982). The pitches prepared by these methods, however, are not necessarily satisfactory, i.e., some pitches have a sufficiently high mesophase content but not sufficiently low softening point, some have a sufficiently low softening point but do not have a sufficiently high mesophase content, some pitches have both a low softening point and a high mesophase content but contains a large amount of significantly high molecular weight mesophase which is insoluble in quinoline and the like and cannot be deemed as homogeneous pitch. We have proposed processes for preparing pitches for use in the production of carbon fibers (Japanese Patent Laid-open Nos. 103989/1986 and 238885/1986), but the pitches obtained from these processes cannot be deemed as satisfactorily excellent pitches, yet. None of these methods is successful in providing a pitch satisfying the following four requisite properties at the same time, that is: (1) a low softening point, (2) a high mesophase content, (3) a low quinoline insoluble content, and (4) a low xylene soluble contenent.

SUMMARY OF THE INVENTION

When preparing carbon fibers from a mesophase pitch, the mesophase must satisfy two requirements, that is, the pitch must be spun with ease into fiber, and it must give carbon fiber with good characteristics when the spun fiber is rendered infusible, carbonized or graphitized. Thus, the development of a process has been desired which is capable of producing a mesophase pitch which satisfies the four requisite properties mentioned above at the same time.

We have made extensive studies on the process for preparing a mesophase pitch spinnable into a high performance carbon fiber, and as a result found that a mesophase pitch which satisfies all of the above-mentioned four required properties can be produced by preliminarily removing from the starting raw material, the components which are insoluble in a monocyclic aromatic hydrocarbon solvent or the components which readily form insolubles in a monocyclic aromatic hydrocarbon solvent when the raw material is subjected to a distillation, a heat treatment or a hydro-treatment, thereby obtaining a refined heavy oil or heavy component; heat treating the thus obtained refined heavy oil or heavy component at a specified condition; recovering the components insoluble in a monocyclic aromatic hydrocarbon solvent which is newly formed by the heat treatment; hydrogenating the insoluble component under heating in the presence of a hydrogen-donating solvent; and then further heat treating the hydrogenated bituminous material, and the finding has led to the completion of this invention. In the case where a special feed stock is used, the preliminary extraction step may be omitted.

According to the process of this invention, because the heat treatment is conducted continuously, the fluctuation of the quality of the product pitches can be minimized.

Accordingly, the primary object of this invention is to provide a process for preparing a mesophase pitch spinnable into a high performance carbon fiber, and specifically a process for preparing a particularly homogeneous mesophase pitch which meets the specific properties, that is, a softening point of below 320° C. as determined by Mettler method, a mesophase content of above 90% as examined on a polarized microscope, a quinoline insoluble content of less than 20%, and a xylene soluble content of less than 20%. According to the process of this invention, a mesophase pitch is readily prepared which usually has a Mettler method softening point of below 310° C., a mesophase content of above 95% as examined on a polarized microscope, a quinoline insoluble content of less than 10%, and a xylene soluble content of less than 10%.

The mesophase pitch prepared by the process of this invention can be used not only as a spinning pitch for the production of carbon fibers, but also as a raw material for preparing other various carbon artifacts.

The second object of this invention is to provide a process for stable production of a mesophase pitch with excellent quality and spinnability for manufacturing carbon fibers from heavy oils of petroleum or coal origin or heavy components, without fluctuation in their quality, by a simple and commercially advantageous process.

The third object of this invention is to provide a commercially valuable process for the preparation of high performance carbon fibers with high tensile strength and high modulus of elasticity hitherto not obtained.

Other objects of this invention will be apparent to those having an ordinary skill in the art from the following detailed descriptions and examples.

Thus, the gist of the first invention resides in a process for preparing a mesophase pitch from a high molecular weight bituminous material by hydrogenation thereof under heating in the presence of a hydrogen-donating solvent, and a successive heat treatment of the thus hydrogenated bituminous material, characterized in that the high molecular weight bituminous material is produced through the following two steps: the first step of subjecting a heavy oil of petroleum or coal origin or a heavy component obtainable by a distillation, a heat treatment or a hydro-treatment thereof, the heavy oil or the heavy component having no or substantially no xylene insoluble component, to a heat treatment in a tubular heater at a temperature of 400°-600° C. under an increased pressure so as to obtain a heat-treated material having 3-30 wt% of xylene insoluble component in the presence or absence of an aromatic oil in an amount of 0-1 times of the heavy oil or heavy component, the aromatic oil having a boiling range of 200°-350° C. and being substantially free of components forming insolubles in a monocyclic aromatic hydrocarbon solvent at the heat treatment in the tubular heater; and the second step of adding to the thus heat-treated material, in an amount of 1-5 times of a monocyclic aromatic hydrocarbon solvent and recovering the newly formed insoluble component.

Further, the gist of the second invention resides in a process for preparing a mesophase pitch from a high molecular weight bituminous material by hydrogenation thereof under heating in the presence of a hydrogen-donating solvent, and a successive heat treatment of the thus hydrogenated bituminous material, characterized in that the high molecular weight bituminous material is produced through the following three steps: the preliminary step of producing a refined heavy oil or heavy component which comprises adding, to a heavy oil of petroleum or coal origin or a heavy component obtainable by a distillation, a heat treatment or a hydro-treatment thereof, a monocyclic aromatic hydrocarbon solvent in an amount of 1-5 times of the heavy oil or heavy component, separating and removing the insoluble components, and removing the monocyclic aromatic hydrocarbon solvent by a distillation; the first step of subjecting the refined heavy oil or heavy component to a heat treatment in a tubular heater at a temperature of 400°-600° C. under an increased pressure so as to obtain a heat-treated material having 3-30 wt% of xylene insoluble component in the presence or absence of an aromatic oil in an amount of 0-1 times of the refined heavy oil or heavy component, the aromatic oil having a boiling range of 200°-350° C. and being substantially free of components forming insolubles in a monocyclic aromatic hydrocarbon solvent at the heat treatment in the tubular heater; and the second step of adding to the thus heat-treated material, in an amount of 1-5 times of a monocyclic aromatic hydrocarbon solvent and recovering the newly formed insoluble component.

DETAILED DESCRIPTION OF THE INVENTION

The term "heavy oil of coal origin" as used herein means coal tars, coal tar pitches, liquefied coals, and the like, and the term "heavy oil of petroleum origin" as used herein means residue of naphtha cracking (naphtha tar), residue of gas oil cracking (pyrolysis tar), residue of fluidized catalytic cracking (decant oil), residues of hydrodesulfurization of heavy petroleum fractions, and the like, and they may be used either alone or as a mixture thereof. The term "heavy component" used herein means a heavy fraction obtained from heavy oil of coal or petroleum origin by a distillation, a heat treatment or a hydro-treatment thereof. In the followings, "heavy oil of coal or petroleum origin and heavy component" are referred to simply as "Heavy oil".

Chemical and physical characteristics of some kinds of "Heavy oil" are shown in Table 1.

TABLE 1

| Kind of Heavy oil | Coal tar | Naphtha tar | Pyrolysis tar | Decant oil | Hydrogenated coal tar |
|---|---|---|---|---|---|
| Sp. Gr. (15/4° C.) | 1.10-1.20 | 1.05-1.10 | 1.05-1.15 | 0.95-1.10 | 1.10-1.20 |
| Viscosity (cSt. at 100° C.) | 1-200 | 5-100 | 2-250 | 2-50 | 1-50 |
| H/C Atomic ratio | 0.6-0.8 | 0.9-1.0 | 0.8-1.2 | 1.2-1.5 | 0.8-1.0 |
| Asphaltene (wt %) | 15-40 | 10-20 | 10-25 | 0-5 | 10-30 |
| Xylene insolubles (wt %) | 2-20 | 0-1 | 0-10 | 0-1 | 1-10 |
| Quinoline insolubles (wt %) | 0.1-5.0 | less than 1 | less than 1 | less than 1 | 0-2.0 |
| Conradson carbon (wt %) | 15-30 | 10-20 | 10-25 | 2-10 | 10-25 |
| Distillation properties (°C.) | | | | | |
| IBP | 180-250 | 170-210 | 180-250 | 170-240 | 160-270 |
| 10 vol. % | 210-300 | 210-240 | 240-320 | 300-370 | 200-350 |
| 30 vol. % | 270-370 | 230-280 | 270-340 | 350-400 | 250-410 |
| 50 vol. % | 360-420 | 270-350 | 330-390 | 370-420 | 350-470 |
| 70 vol. % | 470-530 | 320-400 | 380-460 | 400-450 | 460-550 |

The term "monocyclic aromatic hydrocarbon solvent" herein used means benzene, toluene, xylene, etc. They may be used either alone or as a mixture thereof. These solvents are hereinafter referred to as "BTX solvent". Needless to say, the BTX solvent is not limited to be a pure compound, and it is sufficient so long as the BTX solvent is substantially composed of the above-mentioned monocyclic aromatic hydrocarbons.

The solvent used for the separation of insoluble components from a raw material Heavy oil or the separation of insoluble components newly formed in the first step by a continuous heat treatment in a tubular heater is not limited to the BTX solvent. For example, a mixed solvent having a solvency which being equivalent or substantially equivalent to the solvency of BTX solvent can be used without any difficulties. Such a mixed solvent can easily be prepared by simply mixing, in a suitable ratio, a poor solvent, such as n-hexane, n-heptane, acetone, methyl ethyl ketone, methanol, ethanol, kerosene, gas oil, naphtha, and the like with a good solvent, such as quinoline, pyridine, coal targas oil, wash oil, carbonyl oil, anthracene oil, aromatic low boiling point oil obtainable by distilling a heavy oil, etc. The mixed solvent mentioned above is within the scope of the term "monocyclic aromatic hydrocarbon solvent" (BTX solvent). It is preferred, however, to use a solvent having a simple composition, such as BTX solvent, so as to simplify the solvent recovering procedure.

The present invention will be described hereinafter in more detail in the order of the process steps. The preliminary step comprises removal of components insoluble in the BTX solvent (such components being hereinafter called as "XI components") from the raw material, i.e. the Heavy oil. Taking coal tars as an example, since coal tars are a heavy oil by-produced in the dry distillation of coal, they usually contain very fine soot-like carbons of less than 1 micron which are generally called free carbons. The free carbons are known to interfere with the growth of mesophase when Heavy oil is thermally treated, and moreover, being a solid insoluble in quinoline, the free carbon becomes a cause of the fiber cut off in the spinning operation. Beside free carbons, coal tars contain high molecular weight XI components which are readily transformed into quinoline insoluble components (hereinafter referred to as "QI components") by heat treatment. Therefore, removing free carbons and XI components is important not only for preventing the coke clogging of tubes in the tubular heater at the heat treatment of the first step, but also for reducing QI components in the mesophase pitch which is ultimately obtained. As described above and especially in the gist of the first invention, the preliminary step, i.e., the extraction by the use of the BTX solvent may be omitted in cases where the raw Heavy oil does not or substantially does not contain XI components. Heavy oil of petroleum origin such as, for example, naphtha tar is generally composed of components soluble to the BTX solvent in its entirety, and further, there may be Heavy oil, even if coal origin, which is completely or substantially free of XI components for some reasons. These raw materials need not be subjected to the preliminary step, because there is no or substantially no insoluble component to be removed by the extraction and therefore, there is no effect expected from this step. Such raw materials containing no or substantially no XI components can be regarded as Heavy oil latently received the preliminary step treatment of this invention and is also within the scope of this invention.

Even in the case where the above-mentioned preliminary step can be omitted, it is desirable in order to obtain a more homogeneous excellent quality mesophase pitch to subject the Heavy oil to a heat treatment so that less than 10 wt%, based on the raw material, of XI components are formed, and then to separate and remove these formed XI components. Either a batch process, e.g. heat treatment by the use of an autoclave or a continuous process, e.g. heat treatment by the use of a tubular heater may be employed for the heat treatment.

For example, a naphtha tar having Sp. Gr. 1.0751 and XI content of 0 wt% is heat-treated in a tubular heater with 6 mm internal diameter and 40 m length which being kept within a molten salt bath under a pressure of 20 Kg/cm$^2$.G at a feed charge rate of 17.5 Kg/hr and at a temperature range of 440°–500° C., XI content of the heat-treated product changes depending upon the heat treatment temperature, i.e., 0.2 wt%, 1.2 wt%, 4.0 wt%, 8.1 wt% and 27.6 wt% at 440° C., 460° C., 480° C., 490° C. and 500° C., respectively. Accordingly, when the preliminary heat treatment is conducted continuously by using a tubular heater, it is desirable to conduct the preliminary heat treatment at a temperature range of 460°–490° C. so as to form an appropriate amount of XI component which being separated and removed in the preliminary step. If the same naphtha tar is heat-treated in batchwise by the use of an autoclave under a pressure of 15 Kg/cm$^2$.G for 2 hr at a temperature range of 400°–440° C., XI content of the heat-treated products varies depending upon the heat treatment temperature, such as 0.3 wt%, 1.5 wt%, 3.1 wt%, 6.8 wt% and 13.5 wt% at 400° C., 410° C., 420° C., 430° C. and 440° C., respectively. Accordingly, if the preliminary heat treatment is conducted in batchwise, it is preferable to use a heat treatment temperature of 410°–430° C. so as to form an appropriate amount of XI component. From the above, it is apparent that the conditions to be used in the preliminary heat treatment differ depending upon either a continuous heat treatment by the use of a tubular heater is adopted or a batchwise heat treatment by the use of an autoclave is adopted. Therefore, actual process conditions for conducting the preliminary heat treatment should desirably be decided by experiments.

Further, in the cases shown above, the product obtained by a continuous heat treatment within a tubular heater at a temperature of 500° C. contains almost no QI component. Contrary to this, the product obtained by a batchwise heat treatment in an autoclave at 440° C. at a holding time of 2 hr contains 1.3 wt% of QI component. When compared the XI contents of the former and the latter products, the XI content of the latter product is lower than that of the former product. It is apparent from the descriptions above, when Heavy oil is heat-treated, it must be considered that what kind of operational procedures should be selected. It is preferable to use a continuous heat treatment by using a tubular heater, if the formation of excessively thermally polymerized bituminous materials, such as QI component, should be avoided.

Formation of too much XI components is not desirable since this decreases the ultimate yield of the mesophase pitch.

The quantity of the BTX solvent to be used for the extraction is preferably 1–5 times amount, more preferably 1–3 times amount of the Heavy oil to be treated. A deficient quantity would make the mixed liquid viscous which will worsen the extraction efficiency. On the other hand, the use of too much solvent would make the total volume of the material to be treated larger, thereby making the process uneconomical. The extraction conditions for removing XI component from the heat-treated Heavy oil are a temperature of from ambient temperature to the boiling point of the solvent used, and the temperature being sufficiently high to give a sufficient fluidity to the Heavy oil, a pressure of, usually, from atmospheric pressure to 2 Kg/cm$^2$.G and a residence time of sufficiently dissolve the Heavy oil into the extraction solvent. The extraction may suitably be conducted under agitation. Usually, heat-treated Heavy oil has a viscosity of lower than 1000 cSt. at 100° C., and therefore, Heavy oil has sufficient fluidity even below a boiling point of the extraction solvent and therefore, the mixing of Heavy oil and extraction solvent can be done easily and dissolution of components soluble in BXT solvent into the extraction solvent can, usually, be completed within a short time. Further, when the Heavy oil is subjected to a preliminary heat treatment so as to form xylene insoluble component and removing the xylene insoluble component thus formed from the preliminarily heat-treated material, it is desirable that the preliminarily heat-treated material has a sufficient fluidity even below the boiling point of the extraction solvent used. Either centrifugation or filtration may be employed for separating XI components, although filtration is preferred for completely eliminating fine solid particles such as free carbons, catalysts and other contaminants. The BTX solvent is distilled off from the thus obtained XI components-free clean liquid to obtain refined Heavy oil.

The first step comprises a heat treatment of the refined Heavy oil in a tubular heater to produce XI components.

The refined Heavy oil is continuously heat-treated in a tubular heater at a temperature range of 400°-600° C. so as to obtain a heat-treated product having XI content of 3-30 wt%. Preferred conditions of the heat treatment are a tubular heater outlet pressure of 1-100 Kg/cm$^2$.G and a temperature of 400°-600° C., more preferably, a tubular heater outlet pressure of 2-50 Kg/cm$^2$.G, and most desirably, the outlet pressure of 4-50 Kg/cm$^2$.G and a temperature of 450°-550° C.

When conducting this heat treatment, it is preferable to exist an aromatic oil in the refined Heavy oil to be treated. Such aromatic oil has a boiling range of 200°-350° C., and should not materially produce XI components in conditions of the heat treatment in the tubular heater. The preferred aromatic oil may be a fraction obtainable by the distillation of the raw Heavy oil and having a boiling range of 200°-350° C. The examples are wash oil and the anthracene oil which are the 240°-280° C. fraction and the 280°-350° C. fraction, respectively of coal tars. Aromatic oils having the boiling range mentioned above obtained from heavy oils of petroleum origin can also be used as the aromatic oil. These aromatic oils help to avoid excessive thermal polymerization in the tubular heater, provide an adequate residence time so that the Heavy oil may be thermally decomposed sufficiently, and further prevent coke clogging of the tubes. Accordingly, the aromatic oils must not thermally polymerize itself in a tubular heater to such an extent that their coexistence may accelerate the clogging of the tubes. Those containing high boiling components in a large amount, therefore, are not usable as the aromatic oils specified above. On the other hand, those containing a large amount of lighter components, e.g., boiling below 200° C., are not favorable, because a higher pressure is required to keep them in liquid state in the tubular heater. The quantity of the aromatic oil to be used may be less than the quantity of the refined Heavy oil to be thermally treated. In case where the refined Heavy oil contains a sufficient amount of aromatic oils of the above-mentioned boiling range, the addition of aromatic oils to the raw Heavy oil may be saved.

It is desirable that the feed material immediately before to charge into the tubular heater used in the first step contains at least 10 wt% and preferably more than 20 wt% of a fraction which corresponds to the aromatic oil mentioned above.

The temperature and residence time of the heat treatment can be selected from the range which yields 3-30 wt% of XI components and does not substantially yield QI components. Although the specific conditions differ depending on the raw Heavy oil, a too low temperature and short residence time will result in a low yield of the XI components, thus giving a poor efficiency. On the contrary, a too high temperature or long residence time will bring about an excessive thermal polymerization, thus results in formation of QI components and also coke clogging of the tubes. In the process of this invention, the residence time in a tubular heater used in the first step is, usually, within a range of 10-2000 sec, preferably within a range of 30-1000 sec. As to the pressure of the heat treatment, at a pressure of below 1 Kg/cm$^2$.G at the outlet of the tube, the lighter fractions of the Heavy oil or aromatic oil will vaporize and liquid-gas phase separation will take place. Under this condition, polymerization will occur in the liquid phase so that a larger amount of QI components are produced and coke clogging of the tubes will result. Therefore, a higher pressure is generally preferable, but a pressure of above 100 Kg/cm$^2$.G will make the investment cost of the plant unacceptably expensive. Therefore, the pressures which can keep the Heavy oil to be treated and aromatic oil in a liquid phase are sufficient. As stated above, it is desirable to maintain the outlet pressure of the tubular heater used in the first step within a range of 1-100 Kg/cm$^2$.G and preferably within a range of 2-50 Kg/cm$^2$.G.

The heat treatment at this first step has a great influence on the characteristics of the ultimate products, i.e., the mesophase pitch, and of the carbon fibers produced therefrom, although the reason therefor cannot be explained definitely, at least at the present, by the knowledge or findings so far acquired by or made available to us. This heat treatment can never be carried out in a batch-type pressurized heating facility such as a commonly used autoclave. It is because a batch-type apparatus is incapable of effectively controlling the short holding time, and with such a batch system, one cannot help employing a lower temperature to complement a longer residence time. But, we have experienced that the heat treatment at such conditions involves the production of a considerable amount of coke-like solid materials which are insoluble in quinoline, when the heat treatment is continued long enough to obtain a sufficient amount of XI components. Since the first step of this invention requires a sufficient degree of thermal cracking reaction to take place while preventing the excessive thermal polymerization reaction, it is imperative that the heat treatment be conducted in a tubular heater under the specified conditions.

While considering the all factors mentioned above, the actual conditions for conducting the first step can be selected. A measurement to determine the fact that whether the selected conditions are appropriate or not is to determine the QI content of the product. The conditions giving a product containing more than 1 wt% of QI component are not suitable. It shows that an excessive thermal polymerization occurs in the tubular heater and clogging of tube by coking may arise. When using the heat-treated materials obtained under such severe conditions, after the heat treatment, it is indispensable that the excessively highly polymrized materials formed must be removed from the heat-treated product in any one of operational stages. Contrary to the above, when the product contains QI component less than 1 wt%, the removal of QI component after the heat treatment is unnecessary.

The accurate control of QI content of the product mentioned above can only be done by using a tubular heater and by the use of a refined Heavy oil containing no or almost no XI component.

Further, it was known that the process conditions, such as heating temperature and residence time, of the heat treatment in the tubular heater can be changed by providing a soaking drum after the tubular heater. This procedure can also be used in the process of this invention. However, it is not preferable to select the conditions of the heat treatment in a tubular heater, if the conditions require to use a very long residence time in the soaking drum. The use of a very long residence time in the soaking drum gives similar effects as the use of a batchwise operation, such as an operation in an autoclave and gives the formation of QI component. Accordingly, even if the soaking drum is used, the conditions of heat treatment in a tubular heater should be selected from the conditions described before.

The second step comprises addition of the BTX solvent to the heat-treated materials to separate and recover the XI components newly formed. Prior to the addition of the BTX solvent, the aromatic oils which are added or lighter fractions which are formed by thermal cracking may be removed from the heat-treated material by distillation. However, it is desirable that the material to which the BTX solvent is added in this step is a liquid having a good fluidity at a temperature below the boiling point of the BTX solvent used. If the heat-treated material or the material from which the lighter fractions are removed by distillation is solid or very viscous even at the boiling point of the BTX solvent, a special facility such as a wet grinding mixer or a pressurized heating dissolver is required for mixing and dissolving such solid or viscous material with the BTX solvent. In addition to such facilities, it takes a long time for mixing and dissolving, thereby making the process uneconomical. Another object of adding aromatic oils in the first step is, therefore, to maintain the heat-treated material in a liquid phase with a sufficient fluidity at a temperature below the boiling point of the BTX solvent. Particularly, the use of aromatic oils in the first step is indispensable when the refined Heavy oil produced in the preliminary step is a solid pitch-like material at an ambient temperature. The heat-treated material charged to the extraction treatment of the second step should have a viscosity of lower than 1000 cSt. at 100° C. and such material usually contains fraction having a boiling range equivalent to the aromatic oil in an amount of at least 10 wt% and preferably more than 20 wt%. In cases where the heat-treated material is a liquid having a sufficient fluidity at a temperature below the boiling point of the BTX solvent, the mixing of the heat-treated material with the solvent can easily be conducted, and dissolution of the soluble components into the solvent proceeds within a short time. Therefore, it is sufficient, in order to mix and dissolve such material with the BTX solvent, to charge the latter into the pipe through which the former passes after being cooled by a heat exchanger. If required, a simple device such as a static mixer may be provided in the piping.

Accordingly, the conditions of extraction operation in this step can be selected from the conditions mentioned before relative to the preliminary step.

The quantity of the BTX solvent to be used in the second step may be 1–5 times, preferably 1–3 times of the heat-treated material. The reason for adopting this range is the same as that already explained in connection with the preliminary step, that is, the lower and upper limits are respectively defined from the viewpoint of separating efficiency of the insoluble components and the economy of the treating process.

The separation and recovery of the insoluble components may be conducted with any suitable processes, such as centrifugation, filtration and the like. As described before, mixing and dissolution of the heat-treated material with the solvent may be conducted very easily and smoothly. After cooling the mixture of the heat-treated material and the solvent to room temperature, the mixture per se can be treated in a centrifuge or a filter and thus the insolubles can be continuously separated and recovered. To conduct these procedures, it is sufficient to use a widely used commercially available centrifuge or filter. Further, the separation of the insolubles may be conducted at a temperature of below the boiling point of the solvent used, but usually the separation is carried out at room temperature.

The separated insoluble components may be repeatedly washed with the BTX solvent, but too many repetitions may decrease the efficiency of the treatment and are thus uneconomical. In the process of this invention, although the intended mesophase pitch may be obtained without washing with the solvent, it is preferable to wash once or twice in order to remove as much as possible the material which can only be transformed to mesophase in a slow rate.

However, high molecular weight bituminous material recovered as the insoluble component in this step is not necessarily be composed of 100% XI component. It is sufficient, if the insolubles recovered contain more than 40 wt%, and preferably more than 50 wt% of XI component. In the process of this invention, the heat-treated material obtained from the first step is prepared to contain some amounts of low boiling materials so as to accomplish an easy dissolution into the solvent. Thus, the components soluble in the BTX solvent contained in the high molecular weight bituminous material obtained in the first step have relatively low boiling points. Accordingly, even if the high molecular weight bituminous material contains a considerable amount of component soluble in the BTX solvent, the most parts of the component soluble in the BTX solvent can easily be removed from the high molecular weight bituminous material during the initial stage of the heat treatment for converting it into a mesophase state and therefore, the component difficult to transform into a mesophase can remain only in a slight ratio.

Contrary to the above, if a high molecular weight bituminous material is prepared from a high softening point pitch containing no or substantially no low boiling component by a solvent extraction, removal of the component soluble in the BTX solvent by distillation is difficult, because the component soluble in the BTX solvent per se has a high boiling point, and therefore, to remove the component soluble in the BTX solvent, repetitive washings are required.

Further, it is desirable that the QI content of the high molecular weight bituminous material obtained in this step is lower than 1 wt%. Still further, it is desirable that the high molecular weight bituminous material does not contain a large amount of components insoluble in the hydrogen-donating solvent. Content of QI component and content of the component insoluble in the hydrogen-donating solvent are regulated by the conditions used in the first step. The use of a high molecular weight bituminous material containing a large amount of the component insoluble in the hydrogen-donating solvent will form a large amount of coke-like solid during the hydrogenation treatment, and therefore, is not preferable. Accordingly, when selecting the operation condition of the first step, it is necessary to give a consideration relative to the solvency of the hydrogen-donating solvent to be used.

The high molecular weight bituminous material obtained in the first step shows isotropy when examined on a polarized microscope.

Further, a fraction composed of nearly 100% XI component prepared by repetitive washings of the high molecular weight butiminous material with a suitable solvent, such as xylene, has a Mettler method softening point of higher than 350° C. (i.e. not capable to measure by the method). Contrary to the above, the high molecular weight bituminous material containing 60–80 wt% of XI content shows relatively low softening point of within a range of 150°–300° C. Even if the high molecular weight bituminous material having a Mettler method softening point of 150°–300° C. is heated and melt below 350° C., and then cooled, the texture is still optically isotropic and no mesophase can be formed.

Although there is no special limitation whether or not the same BTX solvent is used in the preliminary and second steps, it is apparent that the use of the same solvent is economical.

The high molecular weight bituminous material obtained by the treatment of the above-mentioned three steps, i.e., the preliminary, the first and the second steps is then submitted to hydrogenation treatment. Since this high molecular weight bituminous material mainly consists of insoluble component in the BTX solvent and has a very high softening point, it can be hydrogenated only with difficulty with hydrogen gas in the presence of a catalyst. Therefore, the hydrogenation must be conducted under heating in the presence of a hydrogen-donating solvent. The high molecular weight bituminous material obtained in the second step still contains some amounts of the BTX solvent and therefore, it must be removed. The removal may be made by means of drying under a reduced pressure. However, this produces a solid bituminous material which may cause difficulty in handling and in mixing with or dissolving in the hydrogen-donating solvent. Therefore, a more preferable method is first to dissolve the pasty high molecular weight bituminous material containing the BTX solvent to the hydrogen-donating solvent, and then to remove the BTX solvent afterward by distillation.

The hydrogenation of the high molecular weight bituminous material by the use of the hydrogen-donating solvent may be conducted in any suitable manner such as those disclosed in Japanese Patent Laid-open Nos. 196292/1983, 214531/1983 and 18421/1983. Since the use of a catalyst necessitates a catalyst separation process and the use of high-pressure hydrogen gas requires high-pressure vessels, it is preferable in view of the economy to conduct the hydrogenation at an autogeneous pressure of the reaction and without catalyst. Further, a continuous hydrogenation treatment may also be used in this invention. For example, a process which comprises dissolving the high molecular weight bituminous material into a hydrogen-donating solvent by mixing and then heat treating the mixture in a tubular heater under an increased pressure, can be employed. To conduct this continuous hydrogenation treatment, it is indispensable that the high molecular weight bituminous material used has the QI content of less than 1 wt% and does not contain a large amount of the components insoluble in hydrogen-donating solvent. If a large amount of the components insoluble in hydrogen-donating solvent exists, the tubular heater may be clogged. The hydrogen-donating solvents usable for the reaction include tetrahydroquinoline, tetralin, dihydronaphthalene, dihydroanthracene, hydrogenated wash oils, hydrogenated anthracene oils, and partially hydrogenated light fractions of naphtha tars or pyrolysis tars, and the like. From the view-point of the ability to dissolve the high molecular weight bituminous materials, tetrahydroquinoline, hydrogenated wash oils, and hydrogenated anthracene oils are preferable. When conducting the hydrogenation in a batch-type apparatus, such as an autoclave, under an autogenous pressure, the method and conditions of the hydrogenation are such that 1–5 parts, preferably 1–3 parts of the hydrogen-donating solvent are added to 1 part of the high molecular weight bituminous material obtained according to this invention and the mixture is heated for 10–100 min at 400°–460° C. under the autogenous pressure. During the hydrogenation operation, the pressure of the reactor will increase gradually and the rate of increment is governed by the kind of hydrogen-donating solvent used and the operation conditions. Usually, the operation pressure at the last stage of the hydrogenation reaction reaches to 20–200 $Kg/cm^2.G$ and the use of a pressure higher than 200 $Kg/cm^2.G$ is not advantageous, because it need to use a very expensive high pressure vessel.

On the other hand, a continuous hydrogenation reaction can easily be performed by mixing the high molecular weight bituminous materials with 1–5 times amount, preferably 1–3 times amount of a hydrogen-donating solvent and sending the mixture into the tubular heater at a temperature of 400°–460° C., under a pressure of 20–100 $Kg/cm^2.G$ and at a velocity to give a residence time of 10–120 min. The continuous hydrogenation reaction is more efficient than the batchwise hydrogenation. By this heat treatment, hydrogen atoms contained in the solvent are transferred to the high molecular weight bituminous material thereby hydrogenation of the high molecular weight bituminous material occurs. A hydrogenated bituminous material is obtained by distilling or flashing the solvent from the liquid which has been subjected to hydrogenation treatment. Prior to removing the solvent, the hydrogenated liquid mixture may be filtered to eliminate insoluble components contained therein. This filtration is desirable though not essential for this invention.

When conducting the hydrogenation treatment in batchwise in an apparatus, such as an autoclave, in some situations, QI component may easily be formed as in the case of the treatment of the first step. Even though a condition which falls within the range described above, if a severe condition, e.g., a combination of high temperature and a long holding time, is selected, QI component will often be formed in an amount of nearly 10 wt%. Accordingly, in this case, removal of insolubles by suitable apparatus, such as filtration is indispensible. Contrary to this, in a continuous hydrogenation treatment by the use of a tubular heater, if a condition within the range described before is selected and when a high molecular weight bituminous material having no or substantially no component insoluble in hydrogen-donating solvent is used as the feed of the hydrogenation reaction, QI component will be formed only scarcely. Therefore, no filtration is required after the hydrogenation treatment.

Further, in the continuous treatment by the use of a tubular heater, hydrogenated bituminous material can be obtained continuously by sending the hydrogenated reaction products to a distillation column or a flash column and separating and removing the hydrogen-donating solvent and ligher fractions formed by the reaction and contained in the Heavy oil, from the reaction products. Thus, a continuous hydrogenation treatment is an efficient operation.

The hydrogenated bituminous material from which the solvent has been removed by distillation or flashing is subjected to a heat treatment. This treatment can be done in any suitable manner, for instance, in batchwise, under a reduced pressure or under blowing of an inert gas and at a temperature of 350°–450° C. for 10–300 min.

Further, it is also possible to conduct the heat treatment continuously by using a continuous processing apparatus, such as a film evaporator at a temperature of 400°–500° C. under a pressure range of from a vacuum to atmospheric pressure. That is, in the process of this invention, the process and the conditions for the heat treatment of the hydrogenated bituminous material are not limited, and any suitable processes and conditions known in the art may be employed.

During this heat treatment, the hydrogenated bituminous material which is substantially isotropic can be transformed into a mesophase pitch exhibiting anisotropy in its entirety or near entirety. When using the high molecular weight bituminous material obtained by the process of this invention, the bituminous material can be readily transformed into entirely anisotropic mesophase pitch, since the material is prepared by a specific procedure and under specific conditions, and is thus composed of stringently selected components.

The process of this invention can provide a mesophase pitch having especially high homogenuity and having the following four required characteristics which have never been satisfied by any one of known pitches; that is, (1) a low softening point of below 320° C. and usually below 310° C., (2) a high mesophase content of above 90% and usually above 95%, (3) a low content of QI components of less than 20% and usually less than 10%, and (4) a low content of xylene soluble components of less than 20% and usually less than 10%.

According to the process of this invention, a very homogeneous mesophase pitch with a low softening point can be prepared. Such a mesophase pitch has never been produced by any known methods. This has been accomplished by using a raw material which is produced by, at first, if it is necessary, removing XI components contained in Heavy oil, heat treating the XI components-free Heavy oil by a specific method and at specific conditions, and then recovering XI components newly formed by the heat treatment. Further, from the facts mentioned above, it has made possible to lower the spinning temperature, which has heretofore been an important subject to be solved, and thus it has made the spinning operation very easy. In addition, excellent carbon fibers can be produced from the mesophase pitch prepared by the process of the present invention.

DESCRIPTION OF THE PREFERRED EMBODIMENTS

This invention will be more materially described by way of the examples. It is to be noted, however, that these examples are given only for the purpose of illustration and therefore, the scope of this invention is not limited thereby.

EXAMPLE 1

A coal tar having a specific gravity of 1.1644 and containing 4.7 wt% of XI components and 0.6 wt% of QI components was flash distilled by a flash distillation column at 280° C. under atmospheric pressure to obtain a heavy component with XI components and QI components of 6.3 wt% and 1.1 wt%, respectively, in a yield of 80.0 wt%. This heavy component was dissolved in twice amount of xylene, and the mixture was continuously filtered at about 25° C. (ambient temperature) by a continuous filter (Leaf Filter; manufactured by Kawasaki Heavy Industries Co., Ltd.) to remove the insoluble components. The filtrate was submitted to distillation to eliminate xylene, thereby obtaining the refined heavy component in a yield of 69.4 wt% based on the coal tar.

Properties of the coal tar, the heavy component and the refined heavy oil are listed in Table 2.

TABLE 2

| | Coal tar | Heavy component | Refined heavy oil |
|---|---|---|---|
| Sp. Gr. (15/4° C.) | 1.1644 | 1.2010 | 1.1550 |
| Viscosity (cSt. at 100° C.) | 3.3 | 17.0 | 7.8 |
| H/C Atomic ratio | 0.73 | 0.74 | 0.73 |
| Asphaltene (wt %) | 22.8 | 29.4 | 25.2 |
| Xylene insolubles (wt %) | 4.7 | 6.3 | 0.9 |
| Quinoline insolubles (wt %) | 0.6 | 1.1 | 0 |
| Conradson carbon (wt %) | 25.2 | 30.9 | 28.2 |
| Distillation properties (°C.) | | | |
| IBP | 189 | 222 | 222 |
| 10 vol. % | 222 | 273 | 282 |
| 30 vol. % | 322 | 352 | 347 |
| 50 vol. % | 401 | 422 | 400 |
| 70 vol. % | 486 | 508 | 471 |

10 Kg/hr of the refined heavy oil and 7.6 Kg/hr of a wash oil were separately charged via pumps to a tubular heater equipped with a heating tube having 6 mm internal diameter and 40 m length dipped within a molten salt bath, where the mixture was thermally treated at a temperature of 510° C., under a pressure of 20 $Kg/cm^2.G$. The thermally treated liquid was added to a twice amount of xylene and mixed. The mixture was then subjected to centrifugation at 2000 rpm under an ambient temperature to obtain the insoluble components, to which twice amount of xylene was added and mixed, and the mixture was again centrifuged in order to wash the insoluble components. A high molecular weight bituminous material was obtained by drying the insoluble components just mentioned above in a yield of 12.4 wt% based on the refined heavy component. Analysis of the high molecular weight bituminous material shows following results: xylene insoluble content of 80.0 wt% and quinoline insoluble content of 0.3 wt%.

250 g of the bituminous material was added to 500 g of tetrahydroquinoline and hydrogenated for 30 min at a temperature of 440° C. and under an autogeneous pressure in an 1 liter autoclave. The final pressure of the treatment was 111 Kg/cm$^2$.G. The hydrogenated liquid was filtered by a glass filter and distilled under reduced pressure to remove the solvent, to afford a hydrogenated high molecular weight butiminous material. The hydrogenated high molecular weight bituminous material thus obtained was put into a polymerization flask and heat-treated in a salt bath kept at 450° C. for 50–70 min while bubbling nitrogen gas at a rate of 80 liter/min per 1 kg of the bituminous material to be treated. Properties of the pitch thus obtained are as shown in Table 3 below:

TABLE 3

| Experiment No. | 1 | 2 | 3 |
|---|---|---|---|
| Time of thermal treatment (min) | 50 | 60 | 70 |
| properties of Pitch | | | |
| Softening Point (Mettler Method) (°C.) | 289 | 297 | 303 |
| Quinoline Insolubles (wt %) | 0.2 | 0.6 | 3.1 |
| Xylene Solubles (wt %) | 9.4 | 9.0 | 5.9 |
| Mesophase Content (%) | 97 | 99 | 100 |

The mesophase pitch of the Experiment No. 3 of the above Table 3 was spun with a spinning apparatus having a nozzle hole with a diameter of 0.25 mm and a length of 0.75 mm at a temperature of 335° C. with a spinning rate of 600 m/min to obtain pitch fibers. The carbon fibers were prepared by rendering the pitch fibers infusible by heating them in the air at 320° C. for 20 min, and then carbonizing them at 1000° C. in a nitrogen atmosphere. The carbon fibers had a tensile strength of 300 Kg/mm$^2$ and a modulus of elasticity of 19.4 ton/mm$^2$. These fibers were further graphitized at 2500° C. The fibers had a tensile strength of 423 Kg/mm$^2$ and a modulus of elasticity of 92.1 ton/mm$^2$.

EXAMPLE 2

The refined heavy oil obtained in Example 1 in the absence of aromatic oil was thermally treated in a tubular heater with an internal diameter of 6 mm and a length of 40 m, at a temperature of 510° C. or 530° C., and under the same pressure as in Example 1. The properties of the thermally treated materials are shown in Table 4.

TABLE 4

| | Heat-treated at 510° C. | Heat-treated at 530° C. |
|---|---|---|
| Sp. Gr. (15/4° C.) | 1.2190 | 1.2278 |
| Viscosity (cSt. at 100° C.) | 55.9 | 168.1 |
| Asphaltene (wt %) | 34.5 | 42.7 |
| Xylene insolubles (wt %) | 12.1 | 15.9 |
| Quinoline insolubles (wt %) | 0.1 | 0.2 |
| Conradson carbon (wt %) | 36.8 | 40.6 |
| Distillation properties (°C.) | | |
| IBP | 203 | 189 |
| 10 vol. % | 307 | 303 |
| 30 vol. % | 377 | 395 |
| 50 vol. % | 457 | 511 |

High molecular weight bituminous materials were obtained by adding twice amount of xylene to each of the thermally treated materials obtained in the above, and the mixtures were treated as in Example 1. The yields of the bituminous materials were 14.9 wt% and 21.3 wt% based on the refined heavy oil for each of the materials heated at 510° C. or 530° C., respectively. The mesophase pitches were obtained by hydrogenating and thermally treating the high molecular weight bituminous material in the same manner as in Example 1. The properties of the pitches are shown in Table 5 below:

TABLE 5

| Experiment No. | 4 | 5 | 6 | 7 | 8 |
|---|---|---|---|---|---|
| Temperature of tubular heater (°C.) | 510 | 510 | 510 | 530 | 530 |
| Time of thermal treatment (min) | 40 | 50 | 60 | 40 | 50 |
| Properties of Pitch | | | | | |
| Softening Point (Mettler Method) (°C.) | 298 | 301 | 305 | 300 | 305 |
| Quinoline Insolubles (wt %) | 0.6 | 1.3 | 2.5 | 1.1 | 1.9 |
| Xylene Solubles (wt %) | 8.1 | 6.9 | 5.4 | 8.6 | 6.5 |
| Mesophase Content (%) | 99 | 100 | 100 | 99 | 100 |

The mesophase pitch of the Experiment No. 6 in Table 5 was spun at 337° C. following the same manner as in Example 1, and then pitch fibers thus obtained were rendered infusible and carbonized at 1000° C. The carbon fibers had a tensile strength of 294 Kg/mm$^2$ and a modulus of elasticity of 18.0 ton/mm$^2$.

EXAMPLE 3

This example is given for comparative purpose and is not within the scope of this invention. The same coal tar as used in Example 1 was flash distilled at 280° C. to obtain a heavy oil, which was mixed with xylene and filtered. The thus obtained XI components were added to twice amount of tetrahydroquinoline and hydrogenated in the same manner as in Example 1. After filtration, the solvent was removed from the hydrogenated product and the product was thermally treated in a salt bath at a temperature of 450° C. for 90 min, thereby obtained a mesophase pitch. The pitch had a Metller method softening point of 320° C., QI content of 12.6 wt%, xylene soluble content of 5.1 wt%, and mesophase content of 85 wt%. This pitch was spun at a temperature of 355° C. The pitch fibers were rendered infusible and carbonized at 1000° C. The carbon fibers had a tensil strength of 228 Kg/mm$^2$ and a modulus of elasticity of 16.2 ton/mm$^2$.

EXAMPLE 4

This example is given for comparative purpose and is not within the scope of this invention. The refined heavy oil prepared in the same manner as in Example 1 was thermally treated in a tubular heater under the same conditions as used in Example 1. The thermally treated liquid was sent, without cooling, to a flash column at 480° C. where lighter fractions were removed to obtain a pitch with a high softening point in a yield of 28.6 wt% based on the refined heavy oil. Twice amount of tetrahydroquinoline was added to the pitch to hydrogenate it under the same condition as used in Example 1 and hydrogenated pitch was thermally treated, thereby obtained a mesophase pitch. The properties of the pitch are shown in Table 6.

TABLE 6

| Experiment No. | 9 | 10 | 11 | 12 |
|---|---|---|---|---|
| Time of thermal treatment (min) | 85 | 105 | 135 | 155 |
| Properties of Pitch | | | | |

TABLE 6-continued

| Experiment No. | 9 | 10 | 11 | 12 |
|---|---|---|---|---|
| Softening Point (Metller Method) (°C.) | 303 | 309 | 317 | 324 |
| Quinoline Insolubles (wt %) | 8.1 | 9.3 | 13.3 | 21.0 |
| Xylene Solubles (wt %) | 12.1 | 11.6 | 7.5 | 3.6 |
| Mesophase Content (%) | 57 | 76 | 89 | 97 |

The mesophase pitch of the Experiment No. 10 in Table 6 was spun at 342° C. following the same manner as in Example 1, and then pitch fibers thus obtained were rendered infusible and carbonized at 1000° C. The carbon fibers had a tensile strength of 242 Kg/mm$^2$ and a modulus of elasticity of 14.2 ton/mm$^2$.

EXAMPLE 5

The refined heavy oil used in Example 1 was heat-treated as in Example 1 at a temperature of 510° C. in a tubular heater. The heat-treated material was sent to a flash column and was flash distilled at a temperature of 280° C. under atmospheric pressure to remove the wash oil used. The heat-treated material obtained from the column bottom was cooled in a cooler to 100° C. After continuously adding a twice amount of xylene to the heat-treated material within a piping, the mixture was cooled to an ambient temperature. The mixture was sent to a continuous centrifuge apparatus (Mini-decanter made by Ishikawajimaharima Heavy Industry Co., Ltd.) and insoluble component formed was separated and recovered. After dispersing the insoluble component in a twice amount of xylene, the dispersion was sent again to the same continuous centrifuge apparatus so as to wash the insoluble component.

After drying the insoluble component in vacuum, the high molecular weight bituminous material was obtained in a yield of 8.8 wt% based on the raw material refined heavy oil. The high molecular weight bituminous material thus obtained had a XI content of 70.5 wt%, and a QI content of 0.1 wt%.

The high molecular weight bituminous material was dissolved in a three times amount of a hydrogenated anthracene oil and the solution was continuously heat-treated in a tubular heater having a heating tube with 10 mm internal diameter and 100 m length dipped in a molten salt bath at a charge rate of 6.5 Kg/hr, at a temperature of 440° C., under a pressure of 50 Kg/cm$^2$.G. Then, the treated solution was immediately sent to a flash column and was flash distilled under atmospheric pressure at a temperature of 400° C. Thus, hydrogenated bituminous material was obtained from the column bottom. The hydrogenated bituminous material had JIS R & B method softening point of 132° C., a XI content of 51.6 wt% and a QI content of 0.1 wt%.

The hydrogenated bituminous material was thermally treated in a polymerization flask as in Example 1 and obtained a mesophase pitch thereby. The properties of the pitch thus obtained are shown in Table 7.

TABLE 7

| Experiment No. | 13 | 14 | 15 | 16 |
|---|---|---|---|---|
| Salt bath temp. (°C.) | 450 | 450 | 430 | 430 |
| Time of thermal treatment (min) | 40 | 50 | 60 | 80 |
| Properties of pitch | | | | |
| Softening point (Mettler method) (°C.) | 305 | 307 | 296 | 301 |
| Quinoline insolubles (wt %) | 5.2 | 7.9 | 0.5 | 2.1 |
| Xylene solubles (wt %) | 4.0 | 3.6 | 7.0 | 5.4 |

TABLE 7-continued

| Experiment No. | 13 | 14 | 15 | 16 |
|---|---|---|---|---|
| Mesophase content (%) | 100 | 100 | 96 | 100 |

The spinning pitch of Experiment No. 15 of Table 7 was spun by using the same spinning apparatus as used in Example 1 in a spinning rate of 850 m/min at a temperature of 325° C. The spun fibers were rendered infusible and carbonized at 1000° C. as in Example 1 and obtained carbon fibers thereby. The carbon fibers had a tensile strength of 298 Kg/mm$^2$ and a modulus of elasticity of 15.9 ton/mm$^2$. The graphite fibers made from the carbon fibers by graphitization at 2500° C. had a tensile strength of 405 Kg/mm$^2$ and a modulus of elasticity of 67.9 ton/mm$^2$.

EXAMPLE 6

A naphtha tar having properties of Sp. Gr. of 1.0751, asphaltene content of 15.1 wt%, XI content of 0 wt%, conradson carbon of 12.3 wt%, viscosity at 100° C. of 6.3 cSt. was heat-treated in the same tubular heater as used in Example 1 at 500° C. in a charge rate of 17.5 Kg/hr. A high molecular weight bituminous material was obtained by mixing the heat-treated material with a twice amount of xylene, centrifuging, washing and drying as in Example 1. 125 g of the high molecular weight bituminous material was dissolved in 250 g of tetrahydroquinoline and the solution was charged into a 1 liter autoclave and a heat treatment was conducted at a temperature of 460° C. under an autogenous pressure for 80 min. The final pressure of the treatment was 116 Kg/cm$^2$.G. After filtration of the treated liquid by a glass filter, the solvent used was removed by distillation. Thus, a hydrogenated bituminous material was obtained. The hydrogenated bituminous material was thermally treated as in Example 1 at a salt bath temperature of 450° C. for 30 min. The pitch thus obtained had a softening point of 310° C., a QI content of 0.8 wt%, a xylene soluble content of 8.5 wt%, a mesophase content of 100 wt%.

The pitch was spun by using the same spinning apparatus as used in Example 1 at 341° C. in a spinning rate of 500 m/min. The pitch fibers were rendered infusible and carbonized at 1000° C. The carbon fibers had a tensile strength of 279 Kg/mm$^2$, and a modulus of elasticity of 15.5 ton/mm$^2$.

We claim:

1. A process for preparing a mesophase pitch with a Mettler method softening point of lower than 320° C., a mesophase content of higher than 90% when examined on a polarized microscope, a quinoline insoluble content of lower than 20% and a xylene soluble content of lower than 20% for manufacturing high performance carbon fibers comprising (a) a first step of subjecting a heavy oil of petroleum or coal origin, or a heavy component obtainable from said heavy oil by a distillation, a heat treatment or a hydro-treatment thereof, said heavy oil or said heavy component having no or substantially no xylene insoluble component, to a heat treatment in a tubular heater at a temperature of 400° to 600° C. under a pressure of 1 to 100 Kg/cm$^2$.G measured at the outlet of said tubular heater for 1 to 2000 sec so as to obtain a heat-treated material having 3 to 30 wt% of xylene insoluble component;

(b) a second step of adding to the thus heat-treated material, a monocyclic aromatic hydrocarbon solvent in an amount of 1 to 5 times based on said heat-treated material, and recovering the newly formed insoluble component as an essentially isotropic high molecular weight bituminous material;

(c) a third step of subjecting said high molecular weight bituminous material to a hydrogenation treatment at a temperature of 400° to 460° C. and a pressure of 20 to 200 Kg/cm$^2$.G with the addition of 1 to 5 times amount of a hydrogen-donating solvent based on said high molecular weight bituminous material thereby obtaining an essentially isotropic hydrogenated pitch; and (d) a fourth step of heat treating said hydrogenated pitch at 350° to 500° C. under a pressure up to atmospheric pressure to convert said hydrogenated pitch into said mesophase pitch.

2. The process as claimed in claim 1, wherein said heat treatment of the first step in said tubular heater is conducted under a pressure of 2–50 Kg/cm$^2$.G measured at the outlet of said tubular heater and at a temperature of 450°–550° C.

3. The process as claimed in claim 1, wherein said mesophase pitch has a Mettler method softening point of lower than 310° C., a mesophase content of higher than 95% when examined on a polarized microscope, a quinoline insoluble content of lower than 10% and a xylene soluble content of lower than 10%.

4. The process as claimed in claim 1, wherein said monocyclic aromatic hydrocarbon solvent is at least one selected from the group consisting of benzene, toluene and xylene.

5. The process as claimed in claim 1, wherein a quinoline insoluble content of the heat-treated material obtained in the first step is lower than 1%.

6. The process as claimed in claim 1, wherein said mesophase pitch is a spinning pitch for manufacturing high performance carbon fibers.

7. A process for preparing a mesophase pitch with a Mettler method softening point of lower than 320° C., a mesophase content of higher than 90% when examined on a polarized microscope, a quinoline insoluble content of lower than 20% and a xylene soluble content of lower than 20% for manufacturing high performance carbon fibers comprising (a) a preliminary step of producing a refined heavy oil or heavy component which comprises adding to a heavy oil of petroleum or coal origin, or a heavy component obtainable from said heavy oil by a distillation, a heat treatment or a hydro-treatment thereof, a monocyclic aromatic hydrocarbon solvent in an amount of 1 to 5 times of said heavy oil or heavy component, separating and removing the insoluble components, and removing the monocyclic aromatic hydrocarbon solvent by a distillation;

(b) a first step of subjecting said refined heavy oil or heavy component to a heat treatment in a tubular heater at a temperature of 400° to 600° C. under a pressure of 1 to 100 Kg/cm$^2$.G measured at the outlet of said tubular heater for 10 to 2000 sec so as to obtain a heat-treated material having 3 to 30 wt% of xylene insoluble component;

(c) a second step of adding to the thus heat-treated material, a monocyclic aromatic hydrocarbon solvent in an amount of 1 to 5 times based on said heat-treated material, and recovering the newly formed insoluble component as an essentially isotropic high molecular weight bituminous material;

(d) a third step of subjecting said high molecular weight bituminous material to a hydrogenation treatment at a temperature of 400° to 460° C. under a pressure of 20 to 200 Kg/cm$^2$.G with the addition of 1 to 5 times amount of a hydrogen-donating solvent based on said high molecular weight bituminous material thereby obtaining an essentially isotropic hydrogenated pitch; and (e) a fourth step of heat treating said hydrogenated pitch at 350° to 500° C. under a pressure up to atmospheric pressure to convert said hydrogenated pitch into said mesophase pitch.

8. The process as claimed in claim 7, wherein said heat treatment of the first step in said tubular heater is conducted under a pressure of 2–50 Kg/cm$^2$.G measured at the outlet of said tubular heater and at a temperature of 450°–550° C.

9. The process as claimed in claim 7, wherein said mesophase pitch has a Mettler method softening point of lower than 310° C., a mesophase content of higher than 95% when examined on a polarized microscope, a quinoline insoluble content of lower than 10% and a xylene soluble content of lower than 10%.

10. The process as claimed in claim 7, wherein said monocyclic aromatic hydrocarbon solvent is at least one selected from the group consisting of benzene, toluene and xylene.

11. The process as claimed in claim 7, wherein the same monocyclic aromatic hydrocarbon solvent is used in the preliminary step and the second step.

12. The process as claimed in claim 7, wherein a quinoline insoluble content of the heat-treated material obtained in the first step is lower than 1%.

13. The process as claimed in claim 7, wherein said mesophase pitch is a spinning pitch for manufacturing high performance carbon fibers.

14. The process of claim 1 wherein said heat-treatment in said first step takes place in the presence of an aromatic oil added in an amount of up to an equal amount to said refined heavy oil or heavy component, said aromatic oil having a boiling range of 200°–350° C. and being substantially free of components which during said heat treatment, form compounds which are insoluble in a monocyclic aromatic hydrocarbon solvent.

15. The process of claim 14 wherein said aromatic oil is added in an amount of 0.1 to 1 times the amount of heavy oil or heavy component.

16. The process of claim 7 wherein said heat-treatment in said first step takes place in the presence of an aromatic oil added in an amount of up to an equal amount to said refined heavy oil or heavy component, said aromatic oil having a boiling range of 200°–350° C. and being substantially free of components which during said heat treatment, form compounds which are insoluble in a monocyclic aromatic hydrocarbon solvent.

17. The process of claim 16 wherein said aromatic oil is added in an amount of 0.1 to 1 times the amount of heavy oil or heavy component.

* * * * *